US010858077B2

(12) United States Patent
Lee et al.

(10) Patent No.: US 10,858,077 B2
(45) Date of Patent: Dec. 8, 2020

(54) VESSEL

(71) Applicant: DAEWOO SHIPBUILDING & MARINE ENGINEERING CO., LTD., Geoje-si (KR)

(72) Inventors: Joon Chae Lee, Seoul (KR); Nam Soo Kim, Suwon-si (KR)

(73) Assignee: Daewoo Shipbuilding & Marine Engineering Co., Ltd., Geoje-si (KR)

( * ) Notice: Subject to any disclaimer, the term of this patent is extended or adjusted under 35 U.S.C. 154(b) by 0 days.

(21) Appl. No.: 15/776,032

(22) PCT Filed: Oct. 24, 2016

(86) PCT No.: PCT/KR2016/011944
§ 371 (c)(1),
(2) Date: May 14, 2018

(87) PCT Pub. No.: WO2017/082552
PCT Pub. Date: May 18, 2017

(65) Prior Publication Data

US 2018/0327056 A1 Nov. 15, 2018

(30) Foreign Application Priority Data

Nov. 12, 2015 (KR) ..... 10-2015-0158922

(51) Int. Cl.
*B63B 25/16* (2006.01)
*F02M 21/02* (2006.01)
(Continued)

(52) U.S. Cl.
CPC ..... *B63B 25/16* (2013.01); *B63H 21/38* (2013.01); *F17C 7/04* (2013.01); *F17C 9/02* (2013.01);
(Continued)

(58) Field of Classification Search
CPC ..... F17C 3/025; F17C 2265/033–034; F17C 2265/037; F25J 1/0025; F25J 1/004;
(Continued)

(56) References Cited

U.S. PATENT DOCUMENTS

2014/0290279 A1* 10/2014 Lee ..... B63B 25/16 62/48.2
2016/0114876 A1* 4/2016 Lee ..... F02C 3/22 60/39.465

FOREIGN PATENT DOCUMENTS

EP 3305645 A1 4/2018
EP 3372484 A1 9/2018
(Continued)

OTHER PUBLICATIONS

International Search Report of PCT/KR2016/011944 which is the parent application and its English translation—4 pages, (dated Jan. 23, 2017).
(Continued)

*Primary Examiner* — Frantz F Jules
*Assistant Examiner* — Erik Mendoza-Wilkenfel
(74) *Attorney, Agent, or Firm* — K&L Gates LLP

(57) ABSTRACT

A vessel includes a heat exchanger for heat-exchanging compressed boil-off gas (hereinafter, referred to as "first fluid") by using, as a refrigerant, the boil-off gas discharged from a storage tank, to cool the same; a main compression part for compressing a part of the boil-off gas discharged from the storage tank; a rest compression part provided in parallel to the main compression part so as to compress the other part of the boil-off gas discharged from the storage tank; and a decompression device for expanding the first fluid having been cooled by exchanging heat with the boil-off gas, which is discharged from the storage tank, in the heat exchanger. The first fluid is a flow in which the boil-off gas compressed by the main compression part and
(Continued)

the boil-off gas compressed by the rest compression part join; or the boil-off gas compressed by the main compression part.

4 Claims, 2 Drawing Sheets

(51) Int. Cl.

| | |
|---|---|
| ***F17C 3/00*** | (2006.01) |
| ***B63H 21/38*** | (2006.01) |
| ***F17C 9/02*** | (2006.01) |
| ***F17C 7/04*** | (2006.01) |

(52) U.S. Cl.
CPC .... *F02M 21/0221* (2013.01); *F17C 2201/052* (2013.01); *F17C 2221/033* (2013.01); *F17C 2223/0161* (2013.01); *F17C 2223/033* (2013.01); *F17C 2227/0157* (2013.01); *F17C 2227/0185* (2013.01); *F17C 2227/036* (2013.01); *F17C 2227/0339* (2013.01); *F17C 2227/0358* (2013.01); *F17C 2265/022* (2013.01); *F17C 2265/034* (2013.01); *F17C 2270/0105* (2013.01)

(58) Field of Classification Search
CPC ..... F25J 1/0045; F25J 1/0202; F25J 1/023; F25J 1/0277; F25J 2210/90; B63B 25/16
See application file for complete search history.

(56) References Cited

FOREIGN PATENT DOCUMENTS

| | | | | | |
|---|---|---|---|---|---|
| JP | 11-210993 | A | | 8/1999 | |
| JP | 2013-209000 | A | | 10/2013 | |
| JP | 2006-348752 | A | | 12/2016 | |
| KR | 10-2002-0069390 | A | | 9/2002 | |
| KR | 10-2008-0031708 | A | | 4/2008 | |
| KR | 10-2010-0044420 | A | | 4/2010 | |
| KR | 10-2015-0001600 | A | | 1/2015 | |
| KR | 20150001600 | A | * | 1/2015 | ..... F02C 3/22 |
| KR | 10-2015-0050113 | A | | 5/2015 | |
| WO | 2014/167219 | A1 | | 10/2014 | |

OTHER PUBLICATIONS

Notice of Allowance in corresponding Korean Patent Application No. 10-2015-0158922—5 pages, (dated May 29, 2017).
Office Action in corresponding Korean Patent Application No. 10-2015-0158922—5 pages, (dated Jan. 5, 2017).
Search Report and Written Opinion of corresponding Singaporean Patent Application No. 11201803869V—10 pages (dated Jul. 23, 2019).
Exteded European search Report of corresponding EP Patent Application No. 16864478.9—10 pages (dated May 20, 2019).
Office Action of corresponding Japanese Patent Application No. 2018-522766—4 pages (dated Apr. 23, 2019).
Office Action of corresponding Japanese Patent Application No. 2018-522766—4 pages (dated Jan. 7, 2020).

* cited by examiner

[FIG 1]
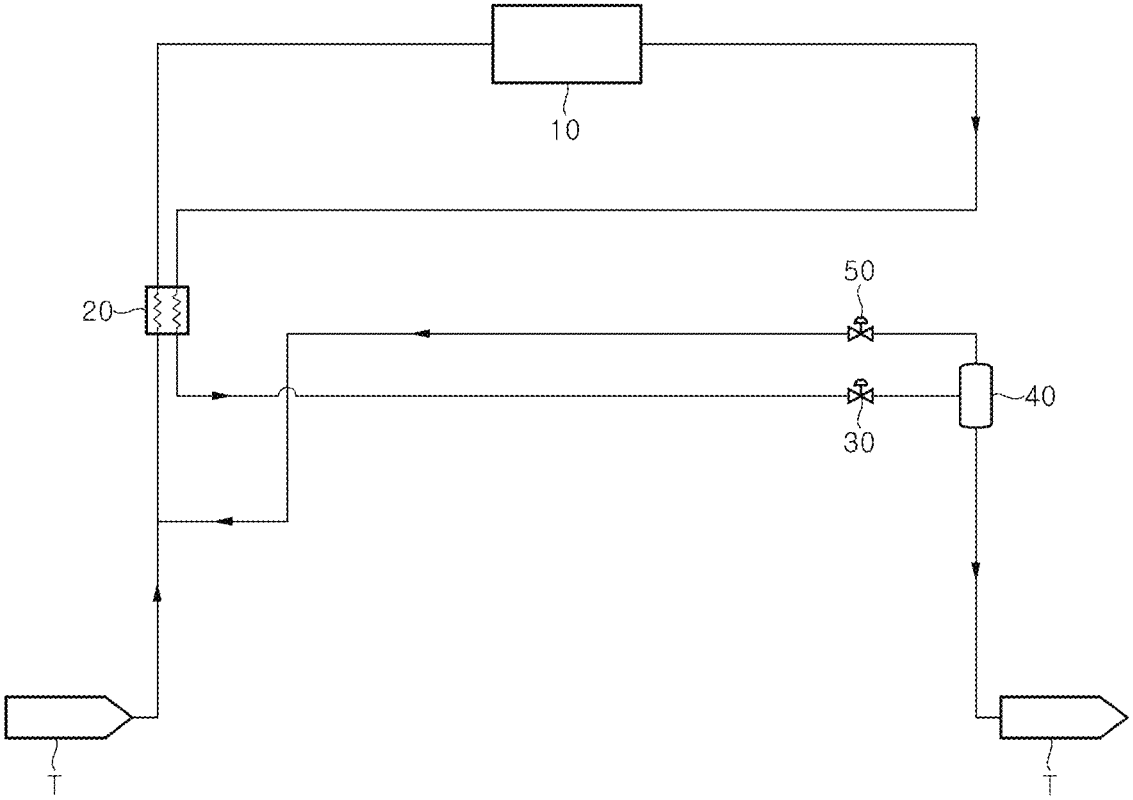

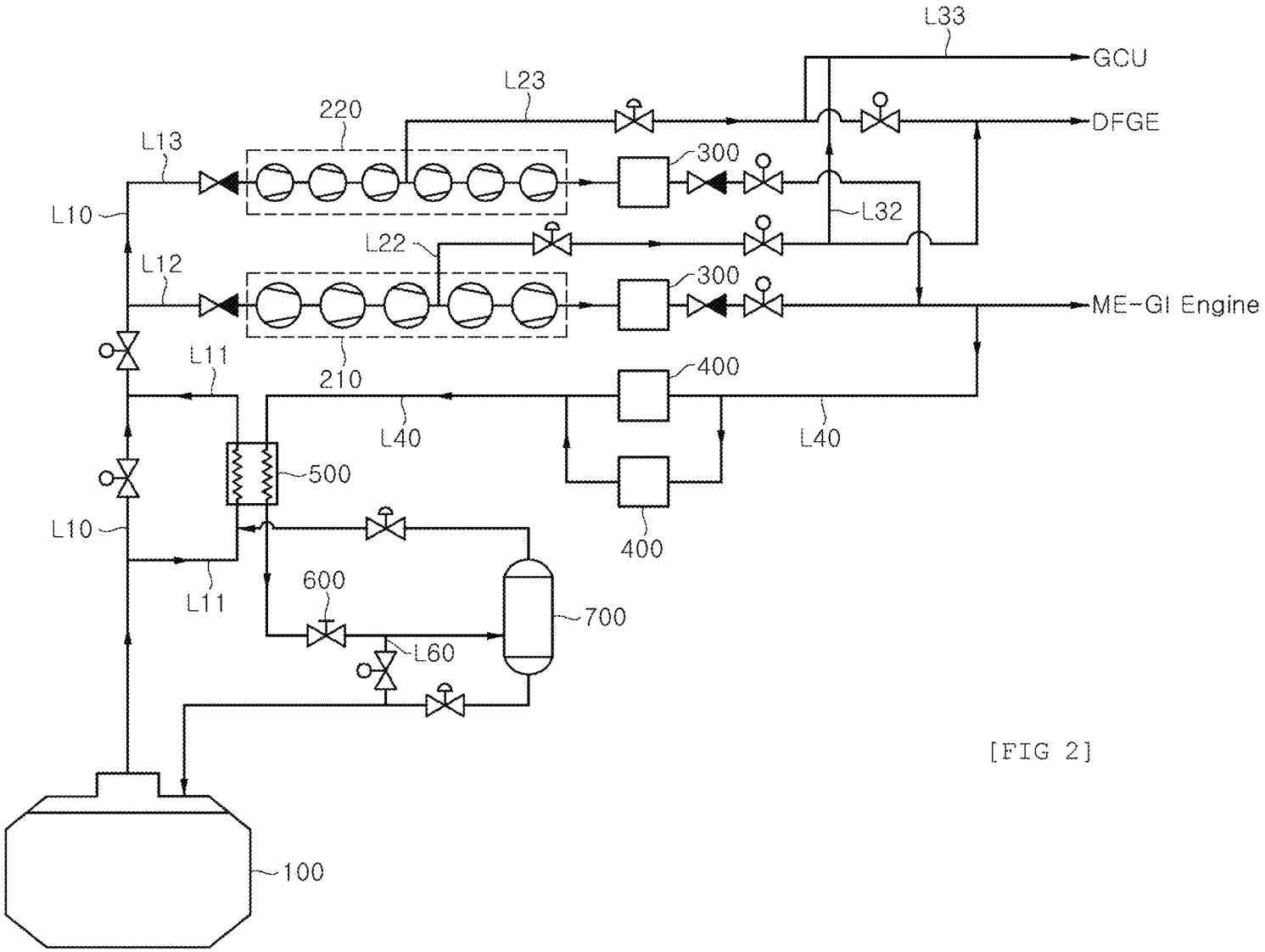
[FIG 2]

VESSEL

TECHNICAL FIELD

The present invention relates to a vessel, and more particularly, to a vessel including a system for re-liquefying boil-off gas left after being used as fuel of an engine among boil-off gases generated in a storage tank.

BACKGROUND ART

In recent years, consumption of liquefied gas such as liquefied natural gas (LNG) has been rapidly increasing worldwide. Since a volume of liquefied gas obtained by liquefying gas at a low temperature is much smaller than that of gas, the liquefied gas has an advantage of being able to increase storage and transport efficiency. In addition, the liquefied gas, including liquefied natural gas, can remove or reduce air pollutants during the liquefaction process, and therefore may also be considered as eco-friendly fuel with less emission of air pollutants during combustion.

The liquefied natural gas is a colorless transparent liquid obtained by cooling and liquefying methane-based natural gas to about −162° C., and has about 1/600 less volume than that of natural gas. Therefore, to very efficiently transport the natural gas, the natural gas needs to be liquefied and transported.

However, since the liquefaction temperature of the natural gas is a cryogenic temperature of −162° C. at normal pressure, the liquefied natural gas is sensitive to temperature change and easily boiled-off. As a result, the storage tank storing the liquefied natural gas is subjected to a heat insulating process. However, since external heat is continuously sent to the storage tank, boil-off gas (BOG) is generated as the liquefied natural gas is continuously vaporized naturally in the storage tank during transportation of the liquefied natural gas. This goes the same for other low-temperature liquefied gases such as ethane.

The boil-off gas is a kind of loss and is an important problem in transportation efficiency. In addition, if the boil-off gas is accumulated in the storage tank, an internal pressure of the tank may rise excessively, and if the internal pressure of the tank becomes more severe, the tank is highly likely to be damaged. Accordingly, various methods for treating the boil-off gas generated in the storage tank have been studied. Recently, to treat the boil-off gas, a method for re-liquefying boil-off gas and returning the re-liquefied boil-off gas to the storage tank, a method for using boil-off gas as an energy source for fuel consumption places like an engine of a vessel, or the like have been used.

As the method for re-liquefying boil-off gas, there are a method for re-liquefying boil-off gas by heat-exchanging the boil-off gas with a refrigerant by a refrigeration cycle using a separate refrigerant, a method for re-liquefying boil-off gas by the boil-off gas itself as a refrigerant without using a separate refrigerant, or the like. In particular, the system employing the latter method is called a partial re-liquefaction System (PRS).

Generally, on the other hand, as engines which can use natural gas as fuel among engines used for a vessel, there are gas fuel engines such as a DFDE engine and an ME-GI engine.

The DFDE engine adopts an Otto cycle which consists of four strokes and injects natural gas with a relatively low pressure of approximately 6.5 bars into an combustion air inlet and compresses the natural gas as the piston lifts up.

The ME-GI engine adopts a diesel cycle which consists of two strokes and employs a diesel cycle which directly injects high pressure natural gas near 300 bars into the combustion chamber around a top dead point of the piston. Recently, there is a growing interest in the ME-GI engine, which has better fuel efficiency and boost efficiency.

DISCLOSURE

Technical Problem

An object of the present invention is to provide a vessel including a system capable of providing better boil-off gas re-liquefying performance than the existing partial re-liquefaction system.

Technical Solution

According to an exemplary embodiment of the present invention, there is provided a vessel including a storage tank storing liquefied gas, the vessel including: a heat exchanger cooling compressed boil-off gas (hereinafter referred to as a "first fluid") through heat exchange using boil-off gas discharged from the storage tank as a refrigerant; a main compression unit compressing a part of the boil-off gas discharged from the storage tank; an extra compression unit disposed in parallel to the main compression unit and compressing the other part of the boil-off gas discharged from the storage tank; and a decompressor expanding the first fluid having been cooled through heat exchange with the boil-off gas discharged from the storage tank in the heat exchanger, wherein the first fluid is a flow in which the boil-off gas compressed by the main compression unit and the boil-off gas compressed by the extra compression unit are joined; or the boil-off gas compressed by the main compression unit.

The vessel may further include a gas-liquid separator separating liquefied gas produced through partial reliquefaction of the boil-off gas through the heat exchanger and the decompressor from the boil-off gas remaining in a gas phase, wherein the liquefied gas separated by the gas-liquid separator is sent to the storage tank, and the boil-off gas separated by the gas-liquid separator is sent to the heat exchanger.

Each of the main compression unit and the extra compression unit may include a plurality of compressors, the boil-off gas having passed through all of the compressors in the main compression unit and the boil-off gas having passed through all of the compressors in the extra compression unit may be sent to a high-pressure engine, and the boil-off gas having passed through some of the compressors of the main compression unit and the boil-off gas having passed through some of the compressors of the extra compression unit may be sent to a low-pressure engine.

Some of the boil-off gas compressed by the main compression unit and some of the boil-off gas compressed by the extra compression unit may be sent to a gas combustion unit to be burnt thereby.

The vessel may further include an oil separator disposed downstream of each of the main compression unit and the extra compression unit and separating an oil from the boil-off gas compressed by the main compression unit or the extra compression unit.

The vessel may further include an oil filter disposed upstream of the heat exchanger and filtering an oil from the boil-off gas to a predetermined concentration or less therein According to another exemplary embodiment of the present invention, there is provided a method wherein, in an initial stage of system operation, boil-off gas discharged from a storage tank is bifurcated into two flows, followed by sending one of the two flows to a main compression unit while sending the other flow to an extra compression unit; as the boil-off gas compressed by the main compression unit and the boil-off gas compressed by the extra compression unit join with each other and start to be supplied to a heat exchanger after the initial stage of system operation, the boil-off gas discharged from the storage tank is sent to the heat exchanger; the boil-off gas discharged from the storage tank and having passed through the heat exchanger is bifurcated into two flows, followed by sending one of the two flows to the main compression unit while sending the other flow to the extra compression unit; the boil-off gas compressed by the main compression unit and the boil-off gas compressed by the extra compression unit are joined with each other, followed by sending some part of the joined boil-off gas to an engine while sending the other part of the joined boil-off gas to the heat exchanger; a fluid cooled in the heat exchanger through heat exchange with the boil-off gas discharged from the storage tank is reliquefied through expansion by a decompressor; and the reliquefied fluid is separated into a gas phase and a liquid phase by a gas-liquid separator such that the liquefied gas is returned to the storage tank and the boil-off gas remaining in the gas phase is joined with the boil-off gas discharged from the storage tank to be sent to the heat exchanger.

During anchoring of the vessel or during transportation of liquefied gas supplied to the vessel at a production site, the extra compression unit may be operated, and during navigation of the vessel or after unloading of the liquefied gas at a demand site, the extra compression unit may not be operated in normal times and may be operated when the main compression unit fails.

The main compression unit and the extra compression unit may be operated when there is a need for rapid treatment of the boil-off gas immediately after navigation of the vessel or immediately before port entry.

The fluid having passed through the heat exchanger and the decompressor may be directly sent to the storage tank after bypassing the gas-liquid separator, when the gas-liquid separator fails.

According to a further exemplary embodiment of the present invention, there is provided an method including: 1) compressing, by a main compression unit, some part of boil-off gas discharged from a storage tank, 2) compressing, by an extra compression unit, the other part of the boil-off gas discharged from the storage tank, 3) joining the boil-off gas compressed in Step 1) with the boil-off gas compressed in Step 2), 4) cooling the boil-off gas joined in Step 3) through heat exchange in a heat exchanger using the boil-off gas discharged from the storage tank as a refrigerant, and 5) decompressing the fluid cooled in Step 4).

Advantageous Effects

As compared with an existing partial re-liquefaction system (PRS), the partial re-liquefaction system according to the present invention can secure the space in the vessel and save the cost of additionally installing the compressor by increasing the re-liquefaction efficiency and the re-liquefaction amount using an extra compression unit already provided in the vessel.

BRIEF DESCRIPTION OF THE DRAWINGS

FIG. 1 is a configuration diagram schematically showing the existing partial re-liquefaction system.

FIG. 2 is a configuration diagram schematically showing a boil-off gas treatment system for vessels according to exemplary embodiments of the present invention.

BEST MODE

Hereinafter, configurations and effects of exemplary embodiments of the present invention will be described with reference to the accompanying drawings. The present invention can variously be applied to vessels such as a vessel equipped with an engine using natural gas as fuel and a vessel including a liquefied gas storage tank. In addition, the following embodiments may be changed in various forms, and therefore the technical scope of the present invention is not limited to the following embodiments.

Boil-off gas systems of the present invention to be described below can be applied to offshore structures such as LNG FPSO and LNG FSRU, in addition to all types of vessels and offshore structures equipped with a storage tank capable of storing a low-temperature fluid cargo or liquefied gas, i.e., vessels such as a liquefied natural gas carrier, a liquefied ethane gas carrier, and LNG RV. However, for convenience of explanation, the following embodiments will describe, by way of example, liquefied natural gas which is a typical low-temperature fluid cargo.

Further, a fluid on each line of the present invention may be in any one of a liquid phase, a gas-liquid mixed state, a gas phase, and a supercritical fluid state, depending on operating conditions of a system.

FIG. 1 is a configuration diagram schematically showing the existing partial re-liquefaction system.

Referring to FIG. 1, in the conventional partial re-liquefaction system, the boil-off gas generated and discharged from a storage tank storing a fluid cargo is sent along a pipe and compressed by a boil-off gas compressor 10.

A storage tank T is provided with a sealing and heat insulating barrier to be able to store liquefied gas such as liquefied natural gas at a cryogenic temperature. However, the sealing and heat insulating barrier may not completely shut off heat transmitted from the outside. Therefore, the liquefied gas is continuously evaporated in the storage tank, so an internal pressure of the storage tank may be increased. Accordingly, to prevent the pressure of the tank from excessively increasing due to the boil-off gas and keep the internal pressure of the tank at an appropriate level, the boil-off gas in the storage tank is discharged and is then supplied to the boil-off compressor 10.

When the boil-off gas discharged from the storage tank and compressed by the boil-off gas compressor 10 is referred to as a first stream, the first flow of the compressed boil-off gas is divided into a second flow and a third stream, and the second flow may be formed to be liquefied and then return to the storage tank T, and the third flow may be formed to be supplied to gas fuel consumption places such as a boost engine and a power generation engine in a vessel. In this case, in the boil-off gas compressor 10 can compress the boil-off gas to a supply pressure of the fuel consumption place, and the second flow may be branched via all or a part of the boil-off gas compressor if necessary. All of the boil-off gas compressed as the third flow may also be supplied according to the amount of fuel required for the fuel consumption place, and all of the compressed boil-off gas may return to the storage tank by supplying the whole amount of boil-off gas as the second stream. An example of the gas fuel consumption places may include a DF generator, a gas turbine, DFDE, and the like, in addition to high pressure gas injection engine (e.g., ME-GI engines developed by MDT Co., etc.) and low-temperature gas injection engines (e.g., generation X-dual fuel engine (X-DF engine) by Wartsila Co.).

At this time, a heat exchanger 20 is provided to liquefy the second flow of the compressed boil-off gas. The boil-off gas generated from the storage tank is used as a cold heat supply source of the compressed boil-off gas. The compressed boil-off gas, that is, the second stream, whose temperature rises while being compressed by the boil-off gas compressor while passing through the heat exchanger 20 is cooled, and the boil-off gas generated from the storage tank and introduced into the heat exchanger 20 is heated and then supplied to the boil-off gas compressor 10.

Since a flow rate of pre-compressed boil-off gas is compressed is greater than that of the second stream, the second flow of the compressed boil-off gas may be at least partially liquefied by receiving cold heat from the boil-off gas before being compressed. As described above, the heat exchanger exchanges heat the low-temperature boil-off gas immediately after being discharged from the storage tank with the high-pressure boil-off gas compressed by the boil-off gas compressor to liquefy the high-pressure boil-off gas.

The boil-off gas of the second flow passing through the heat exchanger 20 is further cooled while being decompressed by passing through an expansion means 30 such as an expansion valve or an expander and is then supplied to a gas-liquid separator 40. The gas-liquid separator 40 separates the liquefied boil-off gas into gas and liquid components. The liquid component, that is, the liquefied natural gas returns to the storage tank, and the gas component, that is, the boil-off gas is discharged from the storage tank to be joined with a flow of boil-off gas supplied to the heat exchanger 20 and the boil-off gas compressor 10 or is then supplied back to the heat exchanger 20 to be utilized as a cold heat supply source which heat-exchanges high-pressure boil-off gas compressed by the boil-off gas compressor 10. Of course, the boil-off gas may be sent to a gas combustion unit (GCU) or the like to be combusted or may be sent to a gas consumption place (including a gas engine) to be consumed. Another expansion means 50 for additionally decompressing the gas separated by the gas-liquid separator before being joined with the flow of boil-off gas may be further provided.

FIG. 2 is a configuration diagram schematically showing a boil-off gas treatment system for vessels according to exemplary embodiments of the present invention.

Referring to FIG. 2, the vessel according to the exemplary embodiments includes a main compression unit 210, an extra compression unit 220, a heat exchanger 500, a decompressor 600, and a gas-liquid separator 700.

A storage tank 100 according to this exemplary embodiment stores liquefied gas such as liquefied natural gas and liquefied ethane gas therein, and is configured to discharge boil-off gas when the internal pressure reaches a preset value or more.

The main compression unit 210 according to this exemplary embodiment compresses some of the boil-off gas discharged from the storage tank 100. The main compression unit 210 may have a structure in which a plurality of compressors is arranged in series. For example, the main compression unit may include five compressors to compress boil-off gas through five stages.

According to this exemplary embodiment, the extra compression unit 220 compresses the remaining boil-off gas discharged from the storage tank 100. The extra compression unit 220 is provided as a redundancy compressor which can be used in place of the main compression unit 210 when the main compression unit 210 cannot be used and is disposed in parallel to the main compression unit 210. Since the extra compression unit 220 is provided to replace the main compression unit 210, it is desirable that the extra compression unit 220 compress the boil-off gas to the same pressure as the main compression unit 210.

The extra compression unit 220 may have a structure wherein the same number of compressors as that of the main compression unit 210 are arranged in series, or a structure wherein a greater number of compressors having a smaller capacity than those of the main compression unit 210 are arranged in series, as shown in FIG. 2.

According to this exemplary embodiment, each of the main compression unit 210 and the extra compression unit 220 can compress boil-off gas to a pressure of about 300 bar, which is required by ME-GI engines. Hereinafter, an engine, such as an ME-GI engine, which employs a relatively high pressure gas as fuel, will be referred to as a 'high-pressure engine'.

According to this exemplary embodiment, the heat exchanger 500 cools the remaining boil-off gas not sent to the high pressure engine, such as an ME-GI engine, in a flow in which the boil-off gas compressed by the main compression unit 210 and the boil-off gas compressed by the extra compression unit 220 join, through heat exchange with the boil-off gas discharged from the storage tank 100.

According to this exemplary embodiment, the decompressor 600 expands the boil-off gas cooled by the heat exchanger 500 through heat exchange with the boil-off gas discharged from the storage tank 100. The decompressor 600 may be an expansion valve such as a Joule-Thomson valve, or an expansion device.

According to this exemplary embodiment, the gas-liquid separator 700 separates the boil-off gas from liquefied natural gas produced by reliquefaction of the boil-off gas through compression by the main compression unit 210 or the extra compression unit 220, cooling by the heat exchanger 500, and expansion by the decompressor 600.

The vessel according to this exemplary embodiment may further include an oil separator 300 disposed downstream of each of the main compression unit 210 and the extra compression unit 220 to separate an oil from the boil-off gas compressed by the main compression unit 210 or the extra compression unit 220.

In addition, the vessel according to this exemplary embodiment may further include an oil filter 400 disposed on Line L40, in which the boil-off gas compressed by the main compression unit 210 and the boil-off gas compressed by the extra compression unit 220 are joined and sent to the heat exchanger 500, and filters the remaining oil not separated by the oil separator 300 to a predetermined concentration or less in the boil-off gas.

Next, a process of reliquefying boil-off gas discharged from the storage tank 100 by the system according to this exemplary embodiment will be described.

In an initial operation stage of the system, boil-off gas discharged from the storage tank 100 is directly supplied to the system along Line L10 without passing through the heat exchanger 500. The boil-off gas supplied along Line L10 is bifurcated into two flows such that one of the two flows is supplied to the main compression unit 210 along Line L12 and the other flow is supplied to the extra compression unit 220 along Line L13.

In the initial operation stage, the boil-off gas discharged from the storage tank 100 is directly supplied to the main compression unit 210 or the extra compression unit 220 along the line L10 without passing through the heat exchanger 500. Then, when the system is operated for a certain period of time to allow some of the boil-off gas compressed by the main compression unit 210 or the extra compression unit 220 to be supplied to the heat exchanger 500, the boil-off gas discharged from the storage tank 100 is sent to the heat exchanger 500 along Line L11 and then bifurcated into two flows in Line L10 such that a part of the boil-off gas is supplied to the main compression unit 210 and the other part of the boil-off gas is supplied to the extra compression unit 220.

The amount of the boil-off gas supplied to the main compression unit 210 along Line L12 may be the same as the amount of the boil-off gas supplied to the extra compression unit 220 along Line L13.

In a conventional partial reliquefaction system (PRS), since boil-off gas is compressed only by the main compression unit 210 in normal times and is compressed only by the extra compression unit 220 when the main compression unit 210 fails, the system according to this exemplary embodiment can compress about twice as much boil-off gas as the conventional partial reliquefaction system. In the conventional partial reliquefaction system, the boil-off gas over the capacity of the compressor is sent to and burnt by a gas combustion unit (GCU) or the like. However, since the system according to this exemplary embodiment can compress most boil-off gas even when the amount of boil-off gas increases, it is possible to achieve reliquefaction of most boil-off gas through significant reduction in the amount of the boil-off gas to be burnt.

Since the amount of boil-off gas in the storage tank 100 is proportional to the amount of liquefied natural gas stored in the storage tank 100, boil-off gas is generated in large amounts during transportation from a production site to a demand site, whereas the boil-off gas is generated in small amounts during transportation from the demand site to the production site after unloading liquefied natural gas at the demand site. Thus, the system according to this exemplary embodiment may be operated such that both the main compression unit 210 and the extra compression unit 220 are operated when the boil-off gas is generated in large amounts, and any one of the main compression unit 210 and the extra compression unit 220 is operated when the boil-off gas is generated in small amounts.

During navigation of a vessel at high speed, the amount of boil-off gas to be reliquefied decreases due to increase in the amount of boil-off gas consumed by engines of the vessel, and during anchoring of the vessel, the engines do not consume the boil-off gas, thereby increasing the amount of boil-off gas to be reliquefied. Thus, the system according to this exemplary embodiment may be operated such that both the main compression unit 210 and the extra compression unit 220 are operated when there is a large amount of boil-off gas to be reliquefied, and any one of the main compression unit 210 and the extra compression unit 220 is operated when there is a small amount of boil-off gas to be reliquefied.

Further, immediately after start of navigation, when a large amount of boil-off gas accumulated during anchoring of the vessel is rapidly treated together with the boil-off gas accumulated immediately after start of navigation in order to secure interior stability of the storage tank 100 while improving conditions of the storage tank 100, both the main compression unit 210 and the extra compression unit 220 may be operated at the same time.

In addition, immediately before port entry, when the boil-off gas is rapidly treated in order to change the conditions of the storage tank 100 corresponding to conditions for port entry, both the main compression unit 210 and the extra compression unit 220 may be operated at the same time.

The two flows of boil-off gas discharged from the storage tank 100, bifurcated and then compressed by the main compression unit 210 or the extra compression unit 220 along Line L12 or L13 are joined to each other. Then, some of the boil-off gas is supplied to a high-pressure engine such as an ME-GI engine and the other boil-off gas is branched to be supplied to the heat exchanger 500 along Line L40.

The boil-off gas compressed by the main compression unit 210 and the boil-off gas compressed by the extra compression unit 220 join with each other and are subjected to cooling by the heat exchanger 500 through heat exchange with the boil-off gas discharged from the storage tank 100 and expansion by the decompressor 600. The liquefied natural gas produced by reliquefaction of the boil-off gas through compression by the main compression unit 210 or the extra compression unit 220, cooling by the heat exchanger 500, and expansion by the decompressor 600 is separated from the remaining boil-off gas by the gas-liquid separator 700 and returned to the storage tank 100. The remaining boil-off gas separated by the gas-liquid separator 700 is joined to boil-off gas discharged from the storage tank 100 and is used as a refrigerant in the heat exchanger 500. When both the main compression unit 210 and the extra compression unit 220 are operated at the same time, the amount of liquefied natural gas separated by the gas-liquid separator 700 becomes higher than the amount of liquefied natural gas separated thereby when only the main compression unit 210 is operated.

According to this exemplary embodiment, the system allows the total amount of the boil-off gas discharged from the storage tank 100 to be sent to the storage tank 100 through reliquefaction, instead of being burnt by a gas combustion unit or directly sent to the storage tank 100, thereby increasing the transportation amount of liquefied natural gas and enabling maintenance of the vessel in an anchored state for a long period of time through reduction or maintenance of internal pressure of the storage tank 100 at a predetermined level.

The fluid subjected to compression by the main compression unit 210 or the extra compression unit 220, cooling by the heat exchanger 500, and expansion by the decompressor 600 may be directly supplied to the storage tank 100 along Line L60, instead of being sent to the gas-liquid separator 700 through the heat exchanger 500, upon failure of the gas-liquid separator 700.

On the other hand, in the structure wherein each of the main compression unit 210 and the extra compression unit 220 includes a plurality of compressors connected to each other in series, some of boil-off gas having passed through some of the plurality of compressors in the main compression unit 210 and some of boil-off gas having passed through some of the plurality of compressors in the extra compression unit 220 may be branched and sent to a DFGE (along Lines L22 and L23). Hereinafter, an engine such as a DF engine, which employs a relatively low pressure gas as fuel, will be referred to as a 'low pressure engine'.

Furthermore, when surplus boil-off gas is generated, some of the boil-off gas sent from the main compression unit 210 to a low pressure engine, such as a DFGE, and some of the boil-off gas sent from the extra compression unit 220 to a low pressure engine, such as a DFGE, may be branched and sent to a gas combustion unit (GCU) to be burnt thereby (along Lines L32 and L33).

It will be apparent to those skilled in the art that valves shown in FIG. 2 can be suitably opened or closed according to the aforementioned process. The present invention is not limited to the above exemplary embodiments and thus it is apparent to those skilled in the art that the exemplary embodiments of the present invention may be variously modified or changed without departing from the technical subjects of the present invention.

The invention claimed is:

1. A method of operating a vessel, the method comprising:

providing the vessel comprising: an engine, an LNG tank containing LNG and boil-off gas (BOG) of the LNG, a BOG processing system comprising a first gas-to-gas pathway, a gas-to-liquid pathway and a second gas-to-gas pathway, the first gas-to-gas pathway configured to generate a pressurized gas composition for sending to the engine, wherein the first gas-to-gas pathway comprises a heat exchanger and a bypass line bypassing the heat exchanger, the gas-to-liquid pathway configured to liquefy a portion of the pressurized gas composition for returning to the LNG tank, the second gas-to-gas pathway connecting between the gas-to-liquid pathway and the first gas-to-gas pathway;

running the first gas-to-gas pathway which comprises:

discharging BOG from the LNG tank, pressurizing, at a first multi-stage compressor, a gas composition comprising BOG discharged from the LNG tank to generate the pressurized gas composition, and supplying part of the pressurized gas composition to the engine;

running the gas-to-liquid pathway which comprises:

branching off a stream of the pressurized gas composition between the first multi-stage compressor and the engine, heat-exchanging, at the heat exchanger, the stream of the pressurized gas composition with the gas composition of the first gas-to-gas pathway to generate a cooled composition, depressurizing the cooled composition at a depressurizer to generate a depressurized composition that comprises a liquid-gas mixture, generating a liquid phase and a gas phase from the liquid-gas mixture at a liquid-gas separator, and returning the liquid phase to the LNG tank; and running the second gas-to-gas pathway which comprises:

sending the gas phase from the liquid-gas separator to the first gas-to-gas pathway for adding to the discharged BOG thus making the gas composition in the first gas-to-gas pathway at a point between the LNG tank and the heat exchanger;

wherein, in a first operation mode, the method runs the first gas-to-gas pathway with the bypass line, in which the gas composition comprising BOG discharged from the LNG tank bypasses the heat exchanger via the bypass line and is pressurized at the first multi-stage compressor to generate the pressurized gas composition, wherein, in a second operation mode, the method runs the first gas-to-gas pathway with the heat exchanger, in which the gas composition comprising BOG discharged from the LNG tank is transmitted to the heat exchanger and heated at the heat exchanger before being pressurized at the first multi-stage compressor, wherein, in a first operation stage of the BOG processing system, the method runs the first gas-to-gas pathway in the first operation mode to bypass the heat exchanger, whereas, in a second operation stage subsequent to the first operation stage of the BOG processing system, the method runs the gas-to-liquid pathway to supply the pressurized gas composition to the heat exchanger, and the method runs the first gas-to-gas pathway to transmit the gas composition comprising BOG discharged from the LNG tank to the heat exchanger for heat exchange of the pressurized gas composition with the gas composition comprising BOG discharged from the LNG tank, wherein the first gas-to-gas pathway further comprises a second multi-stage compressor that is located between the heat exchanger and the engine and the first and second multi-stage compressors are arranged in a fluidly parallel relationship with each other, wherein, when an amount of the BOG discharged from the tank is greater than a predetermined amount, the vessel runs the first gas-to-gas pathway such that the gas composition is divided in two streams at a point upstream of the first and second multi-stage compressors, each of the two streams of the gas composition is supplied to and pressurized in one of the first and second multi-stage compressors, and the pressurized gas composition from the first multi-stage compressor and the pressurized gas composition from the second multi-stage compressor are mixed at a point downstream of the first and second multi-stage compressors for supplying the pressurized gas composition to the engine or the gas-to-liquid pathway, wherein, when an amount of the BOG discharged from the tank is smaller than the predetermined amount, the vessel runs the first gas-to-gas pathway such that the entire amount of the gas composition is supplied to and pressurized in the first multi-stage compressor for supplying the pressurized gas composition to the engine or the gas-to-liquid pathway.

2. The method according to claim 1, compressor is referred to as a first multi stage compressor, and the first gas to gas pathway further comprises a second multi stage compressor arranged in a parallel relationship with the first multi stage compressor between the heat exchanger and the engine, wherein, during anchoring of the vessel or during transportation of liquefied gas supplied to the vessel at a production site, both of the first and second multi-stage compressors are operated, wherein, during navigation of the vessel or after unloading of the liquefied gas at a demand site, the second multi-stage compressor is not operated while the first multi-stage compressor is operated, wherein during navigation of the vessel or after unloading of the liquefied gas at a demand site and when determined that the first multi-stage compressor fails, the second multi-stage compressor is operated.

3. The method of claim 1, wherein, when the vessel departs from a port, the vessel runs the first gas-to-gas pathway such that the gas composition is divided in two streams at a point upstream of the first and second multi-stage compressors, each of the two streams of the gas composition is supplied to and pressurized in one of the first and second multi-stage compressors, and the pressurized gas composition from the first multi-stage compressor and the pressurized gas composition from the second multi-stage compressor are mixed at a point downstream of the first and second multi-stage compressors for supplying the pressurized gas composition to the engine or the gas-to-liquid pathway.

4. The method of claim 1, wherein the first gas-to-gas pathway further comprises an oil separator disposed downstream of the multi-stage compressors, wherein running the first gas-to-gas pathway comprising separating oil from the pressurized gas composition at the oil separator.

* * * * *